US010926983B2

(12) United States Patent
Huang

(10) Patent No.: US 10,926,983 B2
(45) Date of Patent: Feb. 23, 2021

(54) LIFTING DEVICE

(71) Applicant: Ming-Hsien Huang, New Taipei (TW)

(72) Inventor: Ming-Hsien Huang, New Taipei (TW)

( * ) Notice: Subject to any disclaimer, the term of this patent is extended or adjusted under 35 U.S.C. 154(b) by 240 days.

(21) Appl. No.: 16/198,777

(22) Filed: Nov. 22, 2018

(65) Prior Publication Data

US 2019/0284031 A1 Sep. 19, 2019

(30) Foreign Application Priority Data

Mar. 16, 2018 (TW) ..... 107203395

(51) Int. Cl.
*B66F 3/24* (2006.01)
*B66F 3/30* (2006.01)

(52) U.S. Cl.
CPC ..... *B66F 3/247* (2013.01); *B66F 3/30* (2013.01)

(58) Field of Classification Search
CPC .... A47B 9/10; A47B 9/14; A47B 9/20; A47B 2200/0022; A47B 2200/0027; A47B 2200/0052; A47B 13/023; A47B 2013/025; B66F 3/24; B66F 3/247; B66F 3/25; B66F 3/26; B66F 3/28; B66F 3/30; B66F 7/04; B66F 7/10; B66F 7/16; B66F 7/18; B66F 7/28
USPC ..... 254/93 R; 108/147, 147.18, 144.11, 49
See application file for complete search history.

(56) References Cited

U.S. PATENT DOCUMENTS

| | | | | |
|---|---|---|---|---|
| 6,378,816 | B1 * | 4/2002 | Pfister | A47B 9/083 248/157 |
| 9,380,865 | B2 * | 7/2016 | Tempas | A47B 41/02 |
| 9,743,754 | B2 | 8/2017 | Ergun et al. | |
| 2019/0254420 | A1 * | 8/2019 | Rossini | F16M 11/24 |

* cited by examiner

*Primary Examiner* — Monica S Carter
*Assistant Examiner* — Alberto Saenz
(74) *Attorney, Agent, or Firm* — JCIPRNET

(57) ABSTRACT

A lifting device including a first platform, a second platform, a gas spring and a locking device is provided. The first platform includes a base and a first column connected to each other. The second platform includes a working table and a second column connected to each other. The second column and the first column are movably connected. The second column has a plurality of engaging holes. The gas spring includes a first end and a second end opposite to each other. The first end connected to the first column, and the second end connected to the second column. The locking device partially disposed at the first column, and a portion of the locking device being adapted to penetrate the engaging holes to fix a relative position between the second column and the first column.

19 Claims, 12 Drawing Sheets

100

LIFTING DEVICE

CROSS-REFERENCE TO RELATED APPLICATION

This application claims the priority benefit of Taiwan application serial no. 107203395, filed on Mar. 16, 2018. The entirety of the above-mentioned patent application is hereby incorporated by reference herein and made a part of this specification.

BACKGROUND

Technical Field

The invention relates to a lifting device. More particularly, the invention relates to a lifting device with a changeable load carrying capacity.

Description of Related Art

Generally, a supporting mechanism is installed to allow the working table of the lifting device to be raised and lowered, and a gas spring is often used as the supporting mechanism. When the gas spring acts as the supporting mechanism inside the lifting device, the maximum load carrying capacity of the working table of the lifting device to carry an object is determined by the extension force of the gas spring installed. A user may select the corresponding lifting device according to the maximum load carrying capacity required to carry the object to be placed.

Nevertheless, the load carrying capacity can not be adjusted by the gas spring itself. When an object with a weight exceeding the maximum load carrying capacity is placed on the working table by the user, operational stability of the working table when being raised or lowered is thereby reduced. Moreover, if the user needs to place numerous objects with different weights, the user has to purchase different lifting devices of different load carrying capacities. Nevertheless, purchasing various lifting devices of different load carrying capacities is not economical for the user.

SUMMARY

The invention provides a lifting device in which an adjusting apparatus is configured to rotate a gas spring so as to change a maximum load carrying capacity of a working table, and that a user can change the maximum load carrying capacity of the working table as required.

In an embodiment of the invention, a lifting device includes a first platform, a second platform, a gas spring and a locking device. The first platform includes a base and a first column connected to each other. The second platform includes a working table and a second column connected to each other. The second column and the first column are movably connected, such that the working table is raised and lowered relative to the base in a lifting direction. The second column has a plurality of engaging holes. The gas spring includes a first end and a second end opposite to each other. The first end connected to the first column, and the second end connected to the second column. The locking device partially disposed at the first column, and a portion of the locking device being adapted to penetrate the engaging holes to fix a relative position between the second column and the first column.

In an embodiment of the invention, the lifting device further includes an adjusting apparatus, disposed at the first platform, wherein the first end being rotatably disposed at the adjusting apparatus, the second end being rotatably disposed at the second platform, wherein the adjusting apparatus is adapted to adjust the first end to move in an adjustment direction and to rotate the second end so as to change a maximum load carrying capacity of the working table.

In an embodiment of the invention, the gas spring further includes a central axis extending along two opposite ends of the gas spring. The central axis has a first component force in the lifting direction when the central axis is parallel to the lifting direction, and the central axis has a second component force in the lifting direction when the central axis has an included angle with respect to the lifting direction. The first component force is greater than the second component force.

In an embodiment of the invention, the gas spring is adapted to have an included angle along with adjustment made by the adjusting apparatus, and the maximum load carrying capacity decreases when the included angle increases.

In an embodiment of the invention, the first column is fixed onto the base, and the second column is slidably disposed on the first column. The working table is fixed onto the second column, and the first column and the second column are mutually sleeved.

In an embodiment of the invention, the second platform further includes a slot way and an engaging plate. The slot way is located in the second column. The engaging plate is disposed in the slot way.

In an embodiment of the invention, the first end is rotatably disposed at the adjusting apparatus, and the second end is movably disposed at the second column.

In an embodiment of the invention, the adjusting apparatus is disposed at the first column and located at a side of the base. The second end is rotatably disposed at the second column and located at a side of the working table.

In an embodiment of the invention, the lifting device further includes a roller module disposed at the first column. The second column is slidably disposed at the first column through the roller module.

In an embodiment of the invention, the first column has a first cavity. The roller module includes a fixing plate, a rotating shaft, and a roller. The fixing plate is fixed to the first column, the fixing plate has a rotation space and a second cavity corresponding to the first cavity. The rotating shaft is rotatably disposed in the rotation space. The roller is sleeved on the rotating shaft and penetrates the first cavity and the second cavity, and the roller and the second column are in rolling contact with each other.

In an embodiment of the invention, the first platform further includes two through holes opposite to each other. The adjusting apparatus includes a rotating member and a sliding member. The rotating member has a first threaded portion, and the rotating member is rotatably inserted in the two through holes. The sliding member has a second threaded portion corresponding to the first threaded portion. The sliding member is screwed onto the first threaded portion through the second threaded portion, and the first end is rotatably disposed on the sliding member.

In an embodiment of the invention, the rotating member is adapted to rotate in a rotation direction, and the sliding member is adapted to move in the adjustment direction as the rotating member rotates.

In an embodiment of the invention, the rotating member has an adjustment head located outside the first platform. The first threaded portion is connected to the adjustment head, and the adjustment head is adapted to rotate in a rotation direction when being applied by an external force. The first threaded portion is adapted to rotate in the rotation direction along with the adjustment head.

In an embodiment of the invention, the sliding member includes a sliding block and a pivoting portion. The second threaded portion of the sliding block is located in the sliding block. The pivoting portion is connected to the sliding block, and the first end is rotatably disposed on the pivoting portion.

In an embodiment of the invention, the lifting device further includes a rail base disposed in the first column and having a sliding slot extending in the adjustment direction. A portion of the sliding member is located in the sliding slot.

In an embodiment of the invention, the locking device includes a stand, a latch member, a driving member, and a positioning member. The stand is fixed in the first column and has an opening corresponding to the engaging holes. The latch member is slidably inserted in the opening in a first sliding direction. The driving member is slidably disposed at the stand and the latch member in a second sliding direction different from the first sliding direction. The positioning member is fixed to the stand and is adapted to restrict movement of the driving member. The driving member is adapted to move in the second sliding direction after being applied by a force. The latch member is adapted to move in the first sliding direction along with movement of the driving member in the second sliding direction, such that a portion of the latch member is located in the engaging hole or is moved out of the engaging hole.

In an embodiment of the invention, the driving member has as first inclined surface, and the latch member has a second inclined surface corresponding to the first inclined surface. When the driving member moves in the second sliding direction, the first inclined surface of the driving member pushes the second inclined surface of the latch member, wherein the first sliding direction is different from the second sliding direction.

In an embodiment of the invention, the locking device further includes an operation handle and the cable. The operation handle is disposed on the working table. The cable has a third end and a fourth end opposite to each other. The third end is fixed to the operation handle, and the fourth end is coupled to the driving member. The operation handle is adapted to drive the cable, and the driving member is adapted to move in the second sliding direction when the cable is driven.

In an embodiment of the invention, the stand has a main plate and a first abutting plate, and the first abutting plate is connected to the main plate. The driving member has a second abutting plate corresponding to the first abutting plate. The locking device further includes a compression spring, and two opposite ends of the compression spring are respectively propped against the first abutting plate and the second abutting plate. The fourth end is coupled to the second abutting plate.

In an embodiment of the invention, the locking device further includes an adjustment knob rotatably disposed on the stand and adapted to adjust a distance between the fourth end and the first abutting plate. The adjustment knob is adapted to drive the cable to move in the second sliding direction after being applied by a force to rotate.

To sum up, in the lifting device provided by the embodiments of the invention, the first platform includes the base and the first column connected to each other. The second platform includes a working table and a second column connected to each other. The second column and the first column are movably connected, such that the working table is raised and lowered relative to the base in a lifting direction. The adjusting apparatus is disposed at the first platform. The gas spring includes the first end and the second end opposite to each other. The first end is rotatably disposed at the adjusting apparatus, and the second end is rotatably disposed at the second platform. The adjusting apparatus is adapted to adjust the first end to move in the adjustment direction and to rotate the second end, so as to change the maximum load carrying capacity of the working table.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
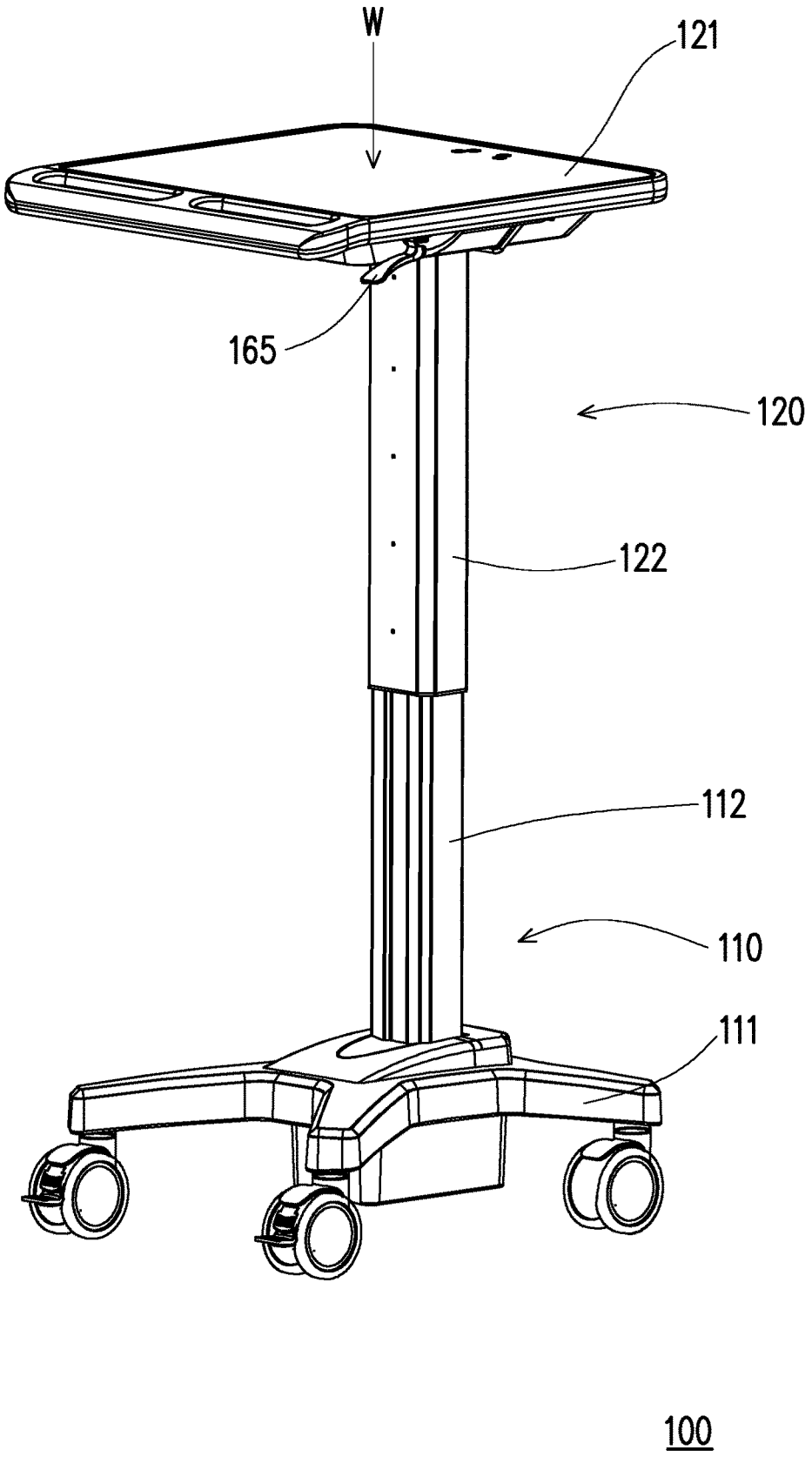
FIG. 1 is a schematic view of a lifting device according to an embodiment of the invention.
Figure 2:
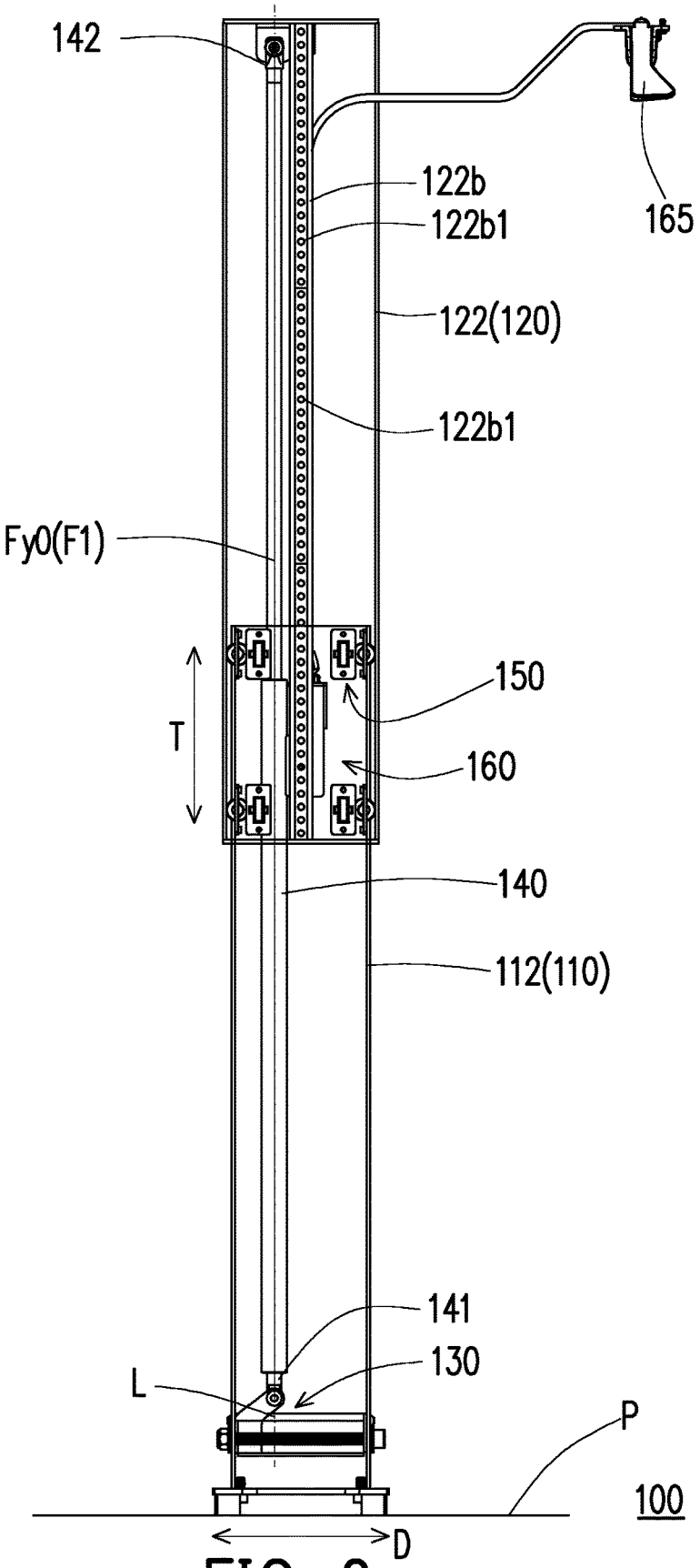
FIG. 2 is a schematic view of a local structure of the lifting device in FIG. 1.
Figure 3:
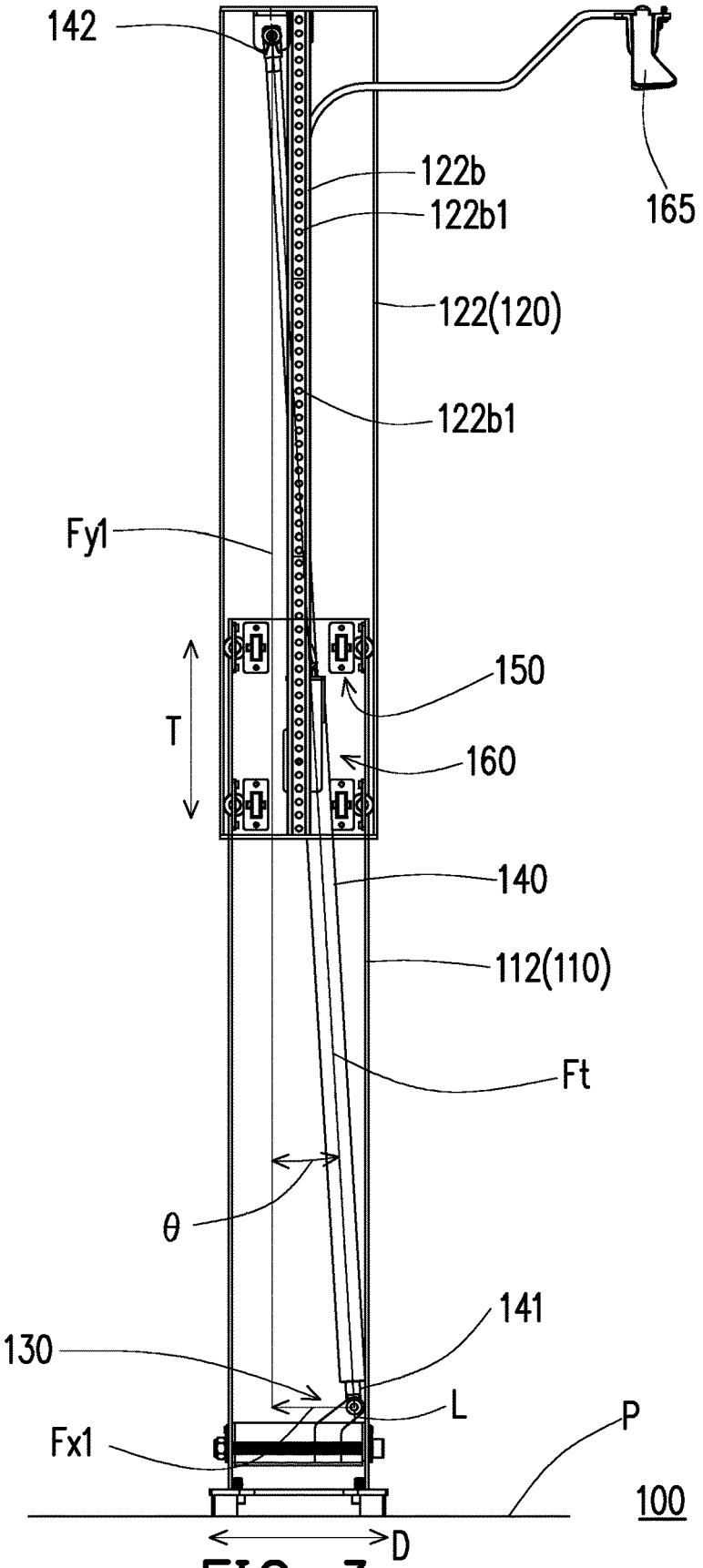
FIG. 3 is a schematic view of a gas spring of the lifting device in FIG. 2 after being driven by an adjusting apparatus.

FIG. 1 is a schematic view of a lifting device according to an embodiment of the invention. FIG. 2 is a schematic view of a local structure of the lifting device in FIG. 1. FIG. 3 is a schematic view of a gas spring of the lifting device in FIG. 2 after being driven by an adjusting apparatus. In order to provide clear illustration and better explanation, part of components are omitted from FIG. 2 and FIG. 3, and an internal structure of a lifting device 100 is depicted in a transparent manner.

With reference to FIG. 1 to FIG. 3, the lifting device 100 includes a first platform 110, a second platform 120, an adjusting apparatus 130, and a gas spring 140. The first platform 110 includes a base 111 and a first column 112 connected to each other. The second platform 120 includes a working table 121 and a second column 122 connected to each other. The second column 122 and the first column 112 are movably connected, such that the working table 121 may be raised and lowered relative to the base 111 in a lifting direction T. The adjusting apparatus 130 is disposed at the first platform 110. The gas spring 140 includes a first end 141 and a second end 142 opposite to each other. The first end 141 is rotatably disposed at the adjusting apparatus 130, and the second end 142 is rotatably disposed at the second platform 120. Among them, the adjusting apparatus 130 is adapted to adjust the first end 141 to move in an adjustment direction D and to rotate the second end 142, so as to change a maximum load carrying capacity W of the working table 121.

Moreover, the gas spring 140 further includes a central axis L extending along two opposite ends of the gas spring 140. An included angle θ is included between the central axis L of the gas spring 140 and the lifting direction T of the first platform 110. The included angle θ may be changed when the adjusting apparatus 130 drives the gas spring 140. In this way, when the adjusting apparatus 130 drives the first end 141 of the gas spring 140 and that the included angle θ is changed relative to the lifting direction T of the first platform 110, the maximum load carrying capacity W of the working table 121 changes as well. In this way, a user is able to change the maximum load carrying capacity W of the working table 121 as required.

An object to be placed on the working table 121 is not particularly limited in this embodiment. As long as a weight of an object falls within the maximum load carrying capacity W of the working table 121, the user may place the corresponding object according to his/her own needs.

When the central axis L of the gas spring 140 is parallel to the lifting direction T of the first platform 110 (i.e., the included angle θ equals 0 degree), the gas spring 140 has a first component force Fy0 in the lifting direction T of on the first platform 110, and the first component force Fy0 is equal to the extension force F1 of the gas spring 140. When the central axis L of the gas spring 140 has the included angle θ with respect to the lifting direction T of the first platform 110, the gas spring 140 has a second component force Fy1 in the lifting direction T of the first platform 110. Herein, the first component force Fy0 is greater than the second component force Fy1, and the second component force Fy1 is smaller than the extension force F1 of the gas spring 140.

Figure 4:
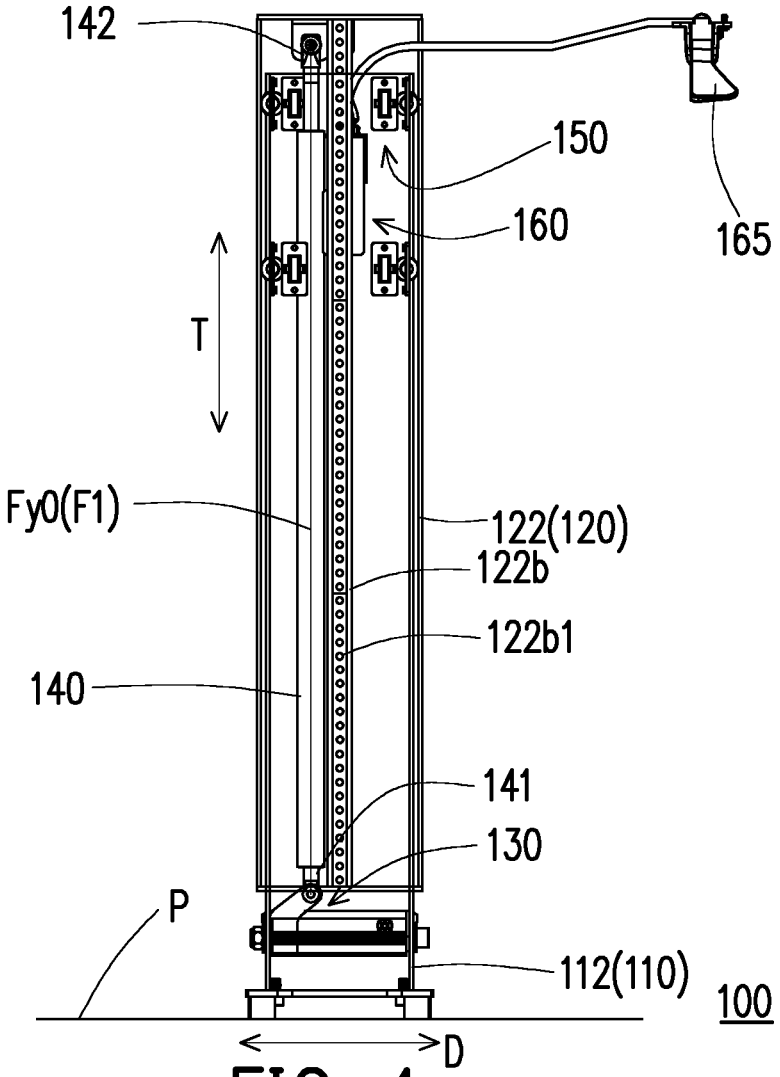
FIG. 4 is a schematic view of the second column of the lifting device in FIG. 2 after being lowered in height.

FIG. 4 is a schematic view of the second column of the lifting device in FIG. 2 after being lowered in height. In order to provide a clear illustration and a better explanation, part of the components are omitted from FIG. 4, and the internal structure of the lifting device 100 is depicted in a transparent manner. To be specific, with reference to FIG. 1, FIG. 2, and FIG. 4 first, an extending direction of the adjustment direction D is exemplified by being perpendicular to the lifting direction T, and an extending direction of the adjustment direction D is exemplified by being parallel to a horizontal plane P in this embodiment. Nevertheless, a relationship between the adjustment direction and the lifting direction and a relationship between the adjustment direction and the horizontal plane are not particularly limited in other embodiments. When the central axis L of the gas spring 140 is parallel to the lifting direction T of the first platform 110 (i.e., the included angle θ equals 0 degree), the gas spring 140 has the first component force Fy0 in the lifting direction T of the first platform 110. Further, a component force of the gas spring 140 in the adjustment direction D of the adjusting apparatus 130 equals 0 degree. In other words, when the central axis L of the gas spring 140 is parallel to the lifting direction T of the first platform 110, an effective force (i.e., the extension force F1 or the first component force Fy0) of the gas spring 140 is concentrated in the lifting direction T.

Figure 5:
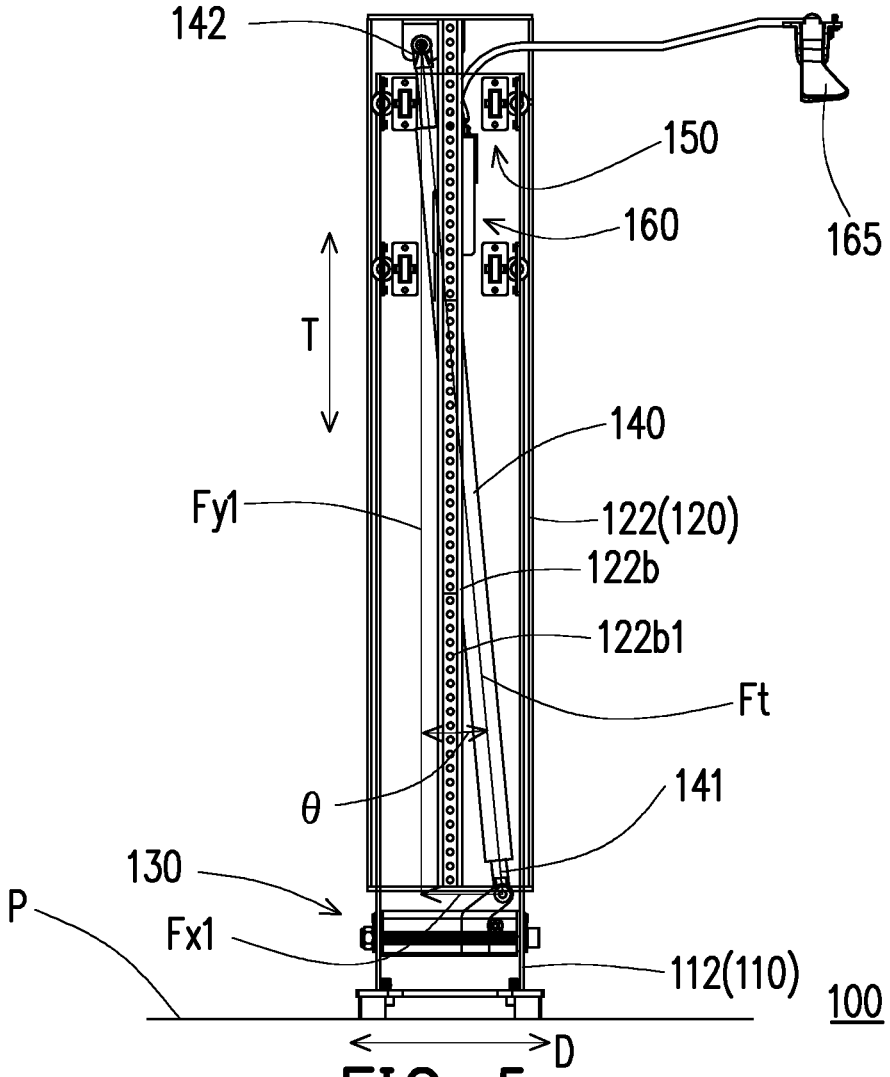
FIG. 5 is a schematic view of the second column of the lifting device in FIG. 3 after being lowered in height.

FIG. 5 is a schematic view of the second column of the lifting device in FIG. 3 after being lowered in height. In order to provide a clear illustration and a better explanation, part of the components are omitted from FIG. 5, and the internal structure of the lifting device 100 is depicted in a transparent manner. With reference to FIG. 1, FIG. 3, and FIG. 5, when the gas spring 140 rotates with respect to the first column 112 and the second column 122 and the included angle θ is provided between the central axis L of the gas spring 140 and the lifting direction T of the first platform 110, the gas spring 140 has the second component force Fy1 in the lifting direction T of the first platform 110. Further, the gas spring 140 has a third component force Fx1 in the adjustment direction D of the adjusting apparatus 130. The third component force Fx1 plus the second component force Fy1A equals a resulting force $F_t$ of the gas spring 140, i.e., $F_t$=Fx1+Fy1, wherein $F_t$=F1=Fy1. In other words, when the central axis L of the gas spring 140 rotates with respect to the first column 112 and the second column 122 and the included angle θ is provided, the resulting force $F_t$ of the gas spring 140 is divided into two component forces in directions of the second component force Fy1 and the third component force Fx1. At this time, a force applied to the working table 121 by the gas spring 140 is the second component force Fy1 perpendicular to the working table 121. That is, since the overall resulting force $F_t$ of the gas spring 140 is divided into the component forces in the two directions of the second component force Fy1 and the third component force Fx1 and only the second component force Fy1 is remained to be applied to the working table 121, the overall effective force of the gas spring 140 applied to the working table 121 is reduced. Hence, the second component force Fy1 is less than the first component force Fy0, and in other words, the first component force Fy0 is greater than the second component force Fy1.

In this way, when the adjusting apparatus 130 drives the gas spring 140 and that the included angle θ is changed relative to the lifting direction T of the first platform 110, the maximum load carrying capacity W of the working table 121 changes. As the included angle θ between the gas spring 140 and the lifting direction T of the first platform 110 increases, the second component force Fy1 applied to the working table 121 by the gas spring 140 decreases. In this way, the user is able to change the maximum load carrying capacity W of the working table 121 as required. That is, when the central axis L of the gas spring 140 is parallel to the lifting direction T of the first platform 110, the effective force applied to the working table 121 by the gas spring 140 is maximized, the maximum load carrying capacity W of the working table 121 thus reaches a maximum. On the contrary, when the included angle θ is provided between the gas spring 140 and the lifting direction T of the first platform 110, since the overall effective force of the gas spring 140 is divided, the maximum load carrying capacity W of the working table 121 decreases. Further, as the included angle θ between the gas spring 140 and the lifting direction T of the first platform 110 increases, the effective force applied to the working table 121 by the gas spring 140 gradually decreases, and the maximum load carrying capacity W of the working table 121 decreases as well. Hence, the user may properly adjust the included angle θ between the gas spring 140 and the lifting direction T of the first platform 110 according to the weight of the object to be placed on the working table 121 as required.

In this embodiment, the first column 112 is fixed onto the base 111, and the second column 122 is slidably disposed on the first column 112. The working table 121 is further fixed onto the second column 122. For instance, the first column 112 and the second column 122 are mutually sleeved, such that the second column 122 is slidably disposed on the first column 112. Nevertheless, the first column and the second column are not limited to be mutually sleeved only in other embodiments. For instance, in other embodiments, the second column may be slidably disposed on the first column by a match of a sliding groove and a sliding block between the first column and the second column. The second column 122 is sleeved on the first column 112 in this embodiment, but the first column 112 may be slidably sleeved on the second column 122 in other embodiments. In addition, the first column 112 and the second column 122 are exemplified by having a telescopic structure of two sections in this embodiment. But in other embodiments, the telescopic structure of the columns is not limited to two sections only. The columns may have three or more sections to enable the first platform to be raised and lowered on the second platform according to design requirement.

Figure 6:
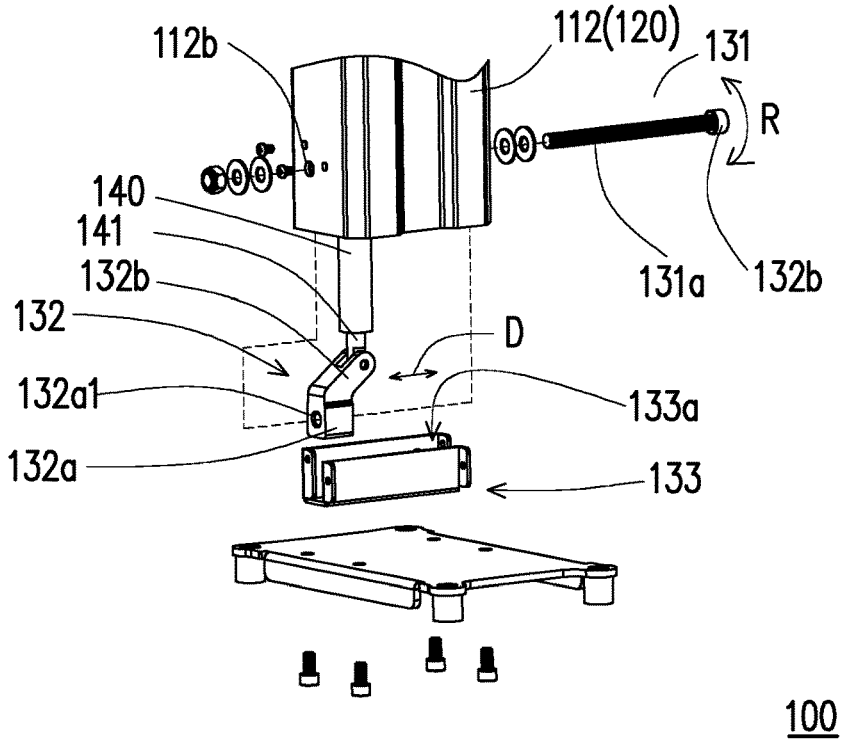
FIG. 6 is a schematic partial exploded view of the adjusting apparatus of the lifting device in FIG. 2.

FIG. 6 is a schematic partial exploded view of the adjusting apparatus of the lifting device in FIG. 2. In order to provide a clear illustration and a better explanation, unnecessary components are omitted from FIG. 6, and the first column 112 is depicted in a truncated manner. With reference to FIG. 2, FIG. 3, and FIG. 6, the first platform 110 has two through holes 112*b* opposite to each other. The through holes 112*b* may be, for example, disposed on the first column 111 of the first platform 110, but positions in which the through holes 112*b* are disposed are not particularly limited. The adjusting apparatus 130 includes a rotating member 131 and a sliding member 132. The rotating member 131 includes a first threaded portion 131*a*, and the first threaded portion 131*a* is, for example, an external thread. The rotating member 131 may be rotatably inserted in one of the through holes 112*b*, and the through hole 112*b* does not have an internal thread, as such, the rotating member 131 does not move axially. The sliding member 132 includes a second threaded portion 132*a*1 corresponding to the first threaded portion 131*a*. That is, the second threaded portion 132*a*1 may be an internal thread corresponding to the first threaded portion 131*a*. The sliding member 132 is screwed onto the first threaded portion 131*a* of the rotating member 131 through the second threaded portion 132*a*1, and the first end 141 of the gas spring 140 is rotatably disposed on the sliding member 132. The rotating member 131 may rotate in a rotation direction R, and the sliding member 132 may move in the adjustment direction D as the rotating member 131 rotates.

To be specific, in this embodiment, the rotating member 131 is, for example, a screw rod and further includes an adjustment head 132*b* located outside the first platform 110. The adjustment head 132*b* is, for example, a screw head or a nut head, and the adjustment head 132*b* may be, for example, disposed outside the first column 111. But a position in which the adjustment head 132*b* is disposed is not particularly limited. The first threaded portion 131*a* is connected to the adjustment head 132*b*, and the adjustment head 132*b* may be applied by a force to rotate in the rotation direction R. The first threaded portion 131*a* may rotate in the rotation direction R along with the adjustment head 132*b*.

In another aspect, the sliding member 132 includes a sliding block 132*a* and a pivoting portion 132*b*, and a second threaded portion 161*a* is located in the sliding block 132*a*. The pivoting portion 132*b* is connected to the sliding block 132*a*, and the first end 141 of the gas spring 140 is rotatably disposed on the pivoting portion 132*b*. In this embodiment, the adjusting apparatus 130 further includes a rail base 133. The rail base 133 is disposed in the first column 112 of the first platform 110, and the rail base 133 has a sliding slot 133*a* extending in the adjustment direction D. The sliding block 132*a* of the sliding member 132 may move back and forth in the sliding slot 133*a* in the adjustment direction D.

In other words, when the rotating member 131 rotates in the rotation direction R, since the through hole 112*b* has no internal thread, the rotating member 131 rotates in a free running way with respect to the through hole 112*b*. As the first threaded portion 131*a* and the second threaded portion 132*a*1 of the sliding member 132 are matched, the free running rotation of the rotating member 131 may induce the sliding member 132 to move in the adjustment direction D. In addition, since the sliding block 132*a* is disposed in the sliding slot 133*a* of the rail base 133, the sliding member 132 is prevented from being deflected axially at the rotating member 131 as the sliding slot 133*a* and the sliding block 132*a* are matched. In this way, efficiency of momentum conversion of the rotating member 131 and the sliding member 132 is ensured.

In this embodiment, the first end 141 of the gas spring 140 is rotatably disposed at the pivoting portion 132*b* of the sliding member 132 in the adjusting apparatus 130, as such, the first end 141 of the gas spring 140 may move and pivot relative to the sliding member 132. In another aspect, the second end 142 of the gas spring 140 is rotatably disposed at the second column 122, as such, the second end 142 of the gas spring 140 may move and pivot relative to the second column 122. Further, the adjusting apparatus 130 is disposed at the first column 112, and the adjusting apparatus 130 is located at a side of the base 111. The second end 142 of the gas spring 140 is rotatably disposed at the second column 122, and the second end 142 of the gas spring 140 is located at a side of the working table 121. In other words, the first end 141 of the gas spring 140 and the second end 142 of the gas spring 140 are respectively located the side of the base 111 and the side of the working table 121. In this embodiment, the adjusting apparatus 130 is exemplified by being disposed at the first column 112 and located at the side of the base 111. But in other embodiments, the adjusting apparatus may also be disposed at the second column and located at the side of the working table, and a location in which the adjusting apparatus is disposed is not particularly limited.

With further reference to FIG. 1, in this embodiment, the second end 142 of the gas spring 140 is preferably disposed at a corner of one end of the second platform 120 in the second column 122 close to the working table 121; nevertheless, a position in which the gas spring 140 is disposed at the second platform 120 is not limited herein. In addition, the pivoting portion 132*b* of this embodiment is connected to the sliding block 132*a*. Moreover, an extending direction of the pivoting portion 132*b* has an angle with respect to the lifting direction T of the first platform 110. Nevertheless, in order to enable the sliding member 132 to move in a greater distance on the rotating member 131, the extending direction of the pivoting portion 132*b* may also be parallel to the lifting direction T of the first platform 110. Here, the direction of the pivoting portion 132*b* extending from the sliding block 132*a* is not particularly limited. In other words, the first end 141 of the gas spring 140 and the second end 142 of the gas spring 140 may be preferably disposed at the first platform 110 and the second platform 120, for example, at two across corners in the first column 112 and the second column 122. In this way, the included angle θ of the gas spring 140 with respect to the lifting direction T of the first platform 110 increases, and a variable range of the maximum load carrying capacity W of the working table 121 thereby increases. Similarly, a width of the first column 112 of the first platform 110 and a width of the second column 122 of the second platform 120 in the adjustment direction D may appropriately increase as well. In this way, the included angle θ of the gas spring 140 with respect to the lifting direction T of the first platform 110 increases, and the variable range of the maximum load carrying capacity W of the working table 121 thereby increases.

Figure 7:
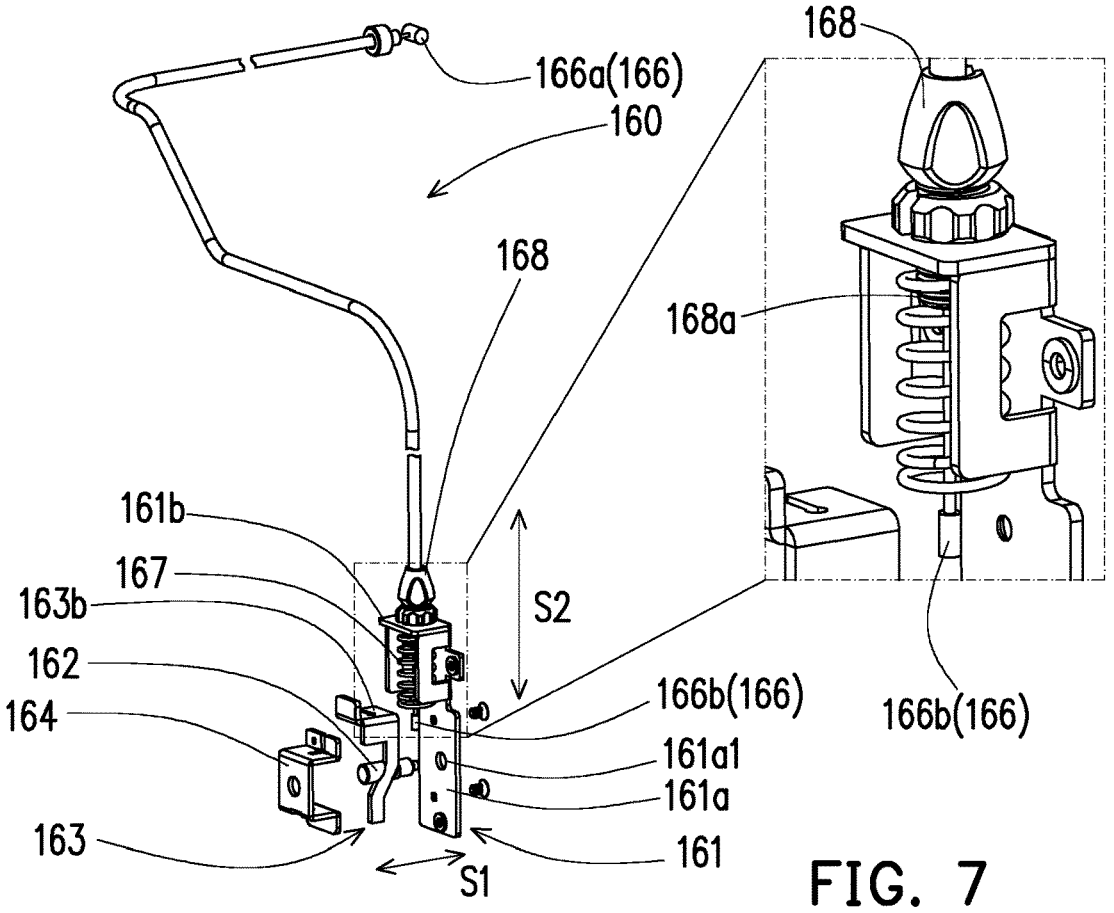
FIG. 7 is a schematic partial exploded view of a locking device of the lifting device in FIG. 2.
Figure 8:
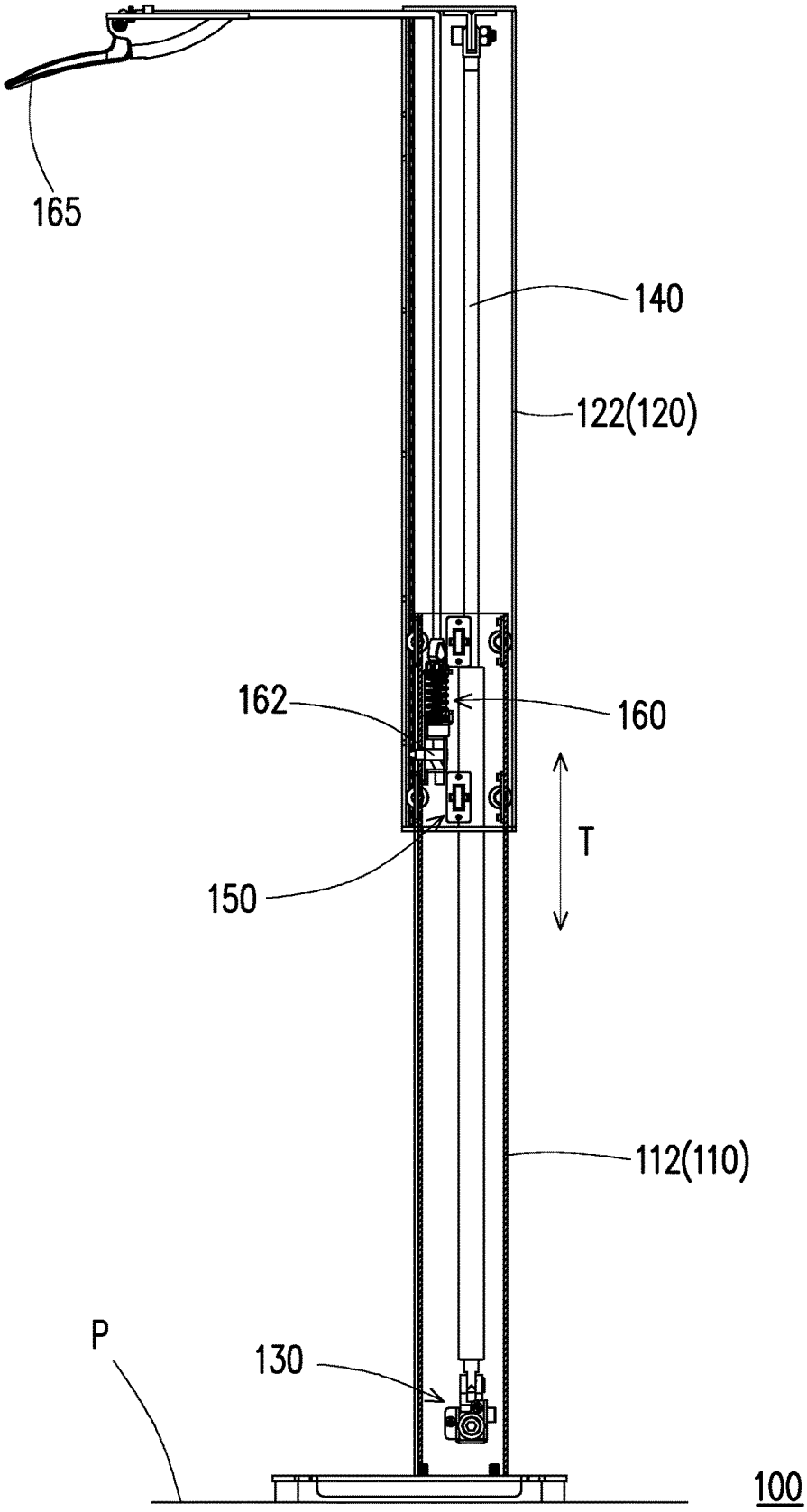
FIG. 8 is a schematic view of the lifting device in FIG. 2 at another angle.

FIG. 7 is a schematic partial exploded view of a locking device of the lifting device in FIG. 2. FIG. 8 is a schematic view of the lifting device in FIG. 2 at another angle. In order to provide a clear illustration and a better explanation, a length of a cable 166 is omitted from FIG. 7 in a truncated manner. With reference to FIG. 2, the second column 122 has a plurality of engaging holes 122*b*1 in this embodiment. With reference to FIG. 7 and FIG. 8, the lifting device 100 further includes a locking device 160. The locking device 160 is partially disposed at the first column 112, and a portion of the locking device 160 penetrates the engaging hole 122*b*1 to fix a relative position between the second column 122 and the first column 112. For instance, the locking device 160 may be partially disposed at the first column 112, and a portion of the locking device 160 may penetrate the engaging hole 122*b*1 to fix the relative position between the second column 122 and the first column 112. Nevertheless, the locking device may also be partially disposed at the second column in other embodiments, and a position in which the locking device is disposed is not particularly limited herein.

Figure 9:
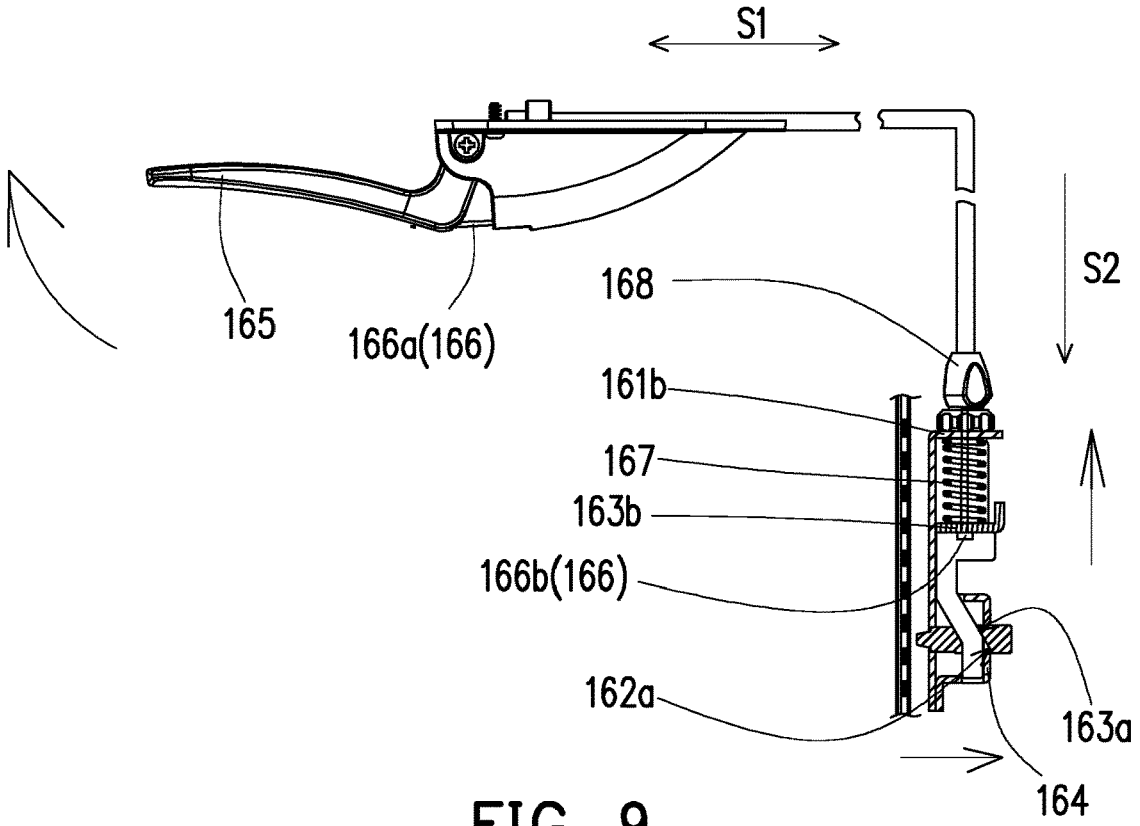
FIG. 9 and FIG. 10 are schematic views illustrating actuation of the locking device of the lifting device in FIG. 2.
Figure 10:
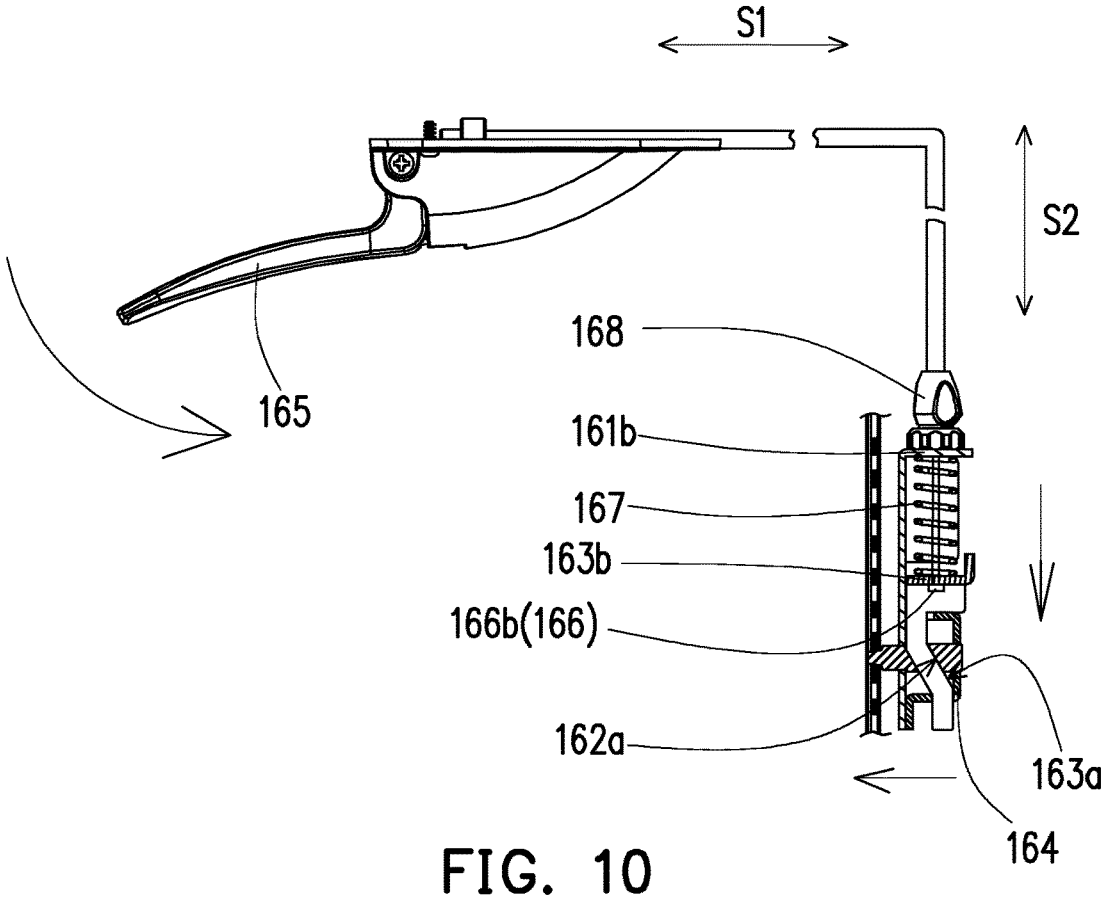
Figure 11:
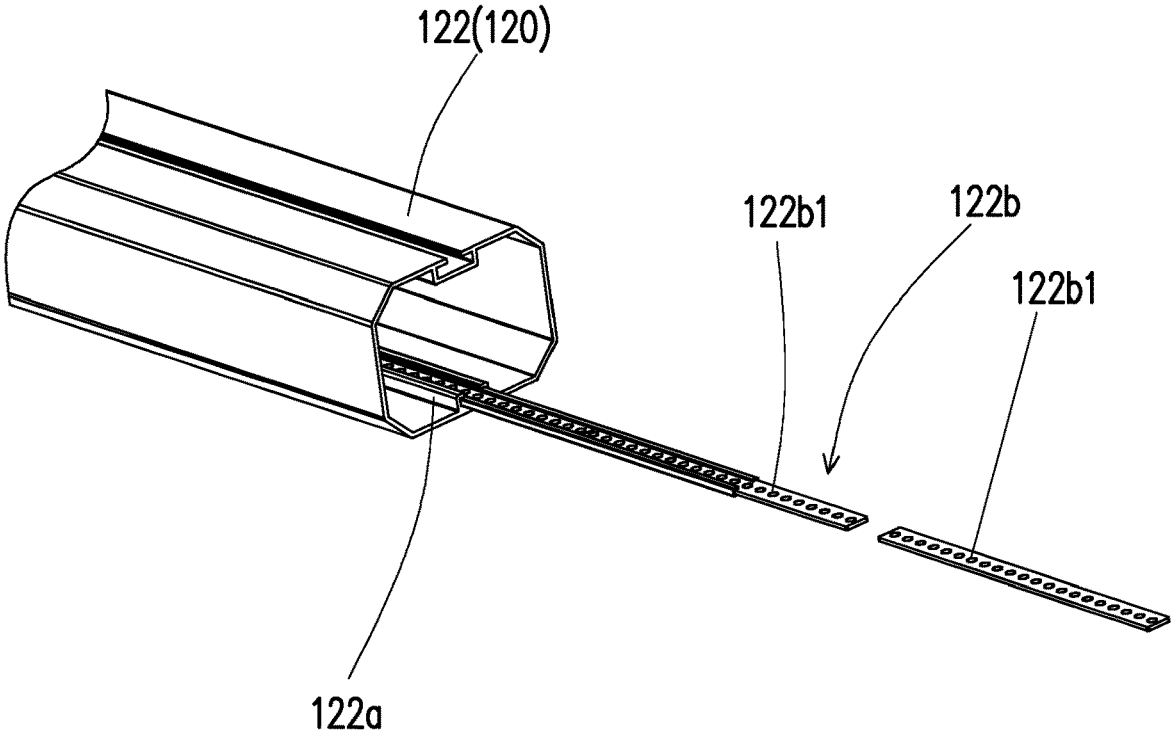
FIG. 11 is a schematic partial exploded view of the second column of the lifting device in FIG. 2.

FIG. 9 and FIG. 10 are schematic views illustrating actuation of the locking device of the lifting device in FIG. 2. FIG. 11 is a schematic partial exploded view of the second column of the lifting device in FIG. 2. In order to provide a clear illustration and a better explanation, the length of the cable 166 is omitted from FIG. 9 and FIG. 10 in a truncated manner, and the second column 122 is depicted in a truncated manner in FIG. 11. With further reference to FIG. 9 to FIG. 11, to be specific, the locking device 160 includes a stand 161, a latch member 162, and a driving member 163. The stand 161 is fixed in the first column 112 and has an opening 161*a*1 corresponding to the engaging holes 122*b*1. The latch member 162 is slidably inserted in the opening 161*a*1 in a first sliding direction S1. The driving member 163 is slidably disposed at the stand 161 and the latch member 162 in a second sliding direction S2 different from the first sliding direction S1. Further, the driving member 162 may move in the second sliding direction S2 after being applied by a force. The latch member 162 may move in the first sliding direction S1 along with sliding movement of the driving member 163 in the second sliding direction S2, such that a portion of the latch member 162 is selectively located in the engaging hole 122*b*1 or moved out of the engaging hole 122*b*1.

To be specific, the driving member 163 has as first inclined surface 163*a*, and the latch member 162 has a second inclined surface 162*a* corresponding to the first inclined surface 163*a*. When the driving member 163 moves in the second sliding direction S2, the first inclined surface 163*a* of the driving member 163 pushes the second inclined surface 162*a* of the latch member 162, wherein the first sliding direction S1 is different from the second sliding direction S2. In this embodiment, the first sliding direction S1 is exemplified by being parallel to the horizontal plane P, and the first sliding direction S1 is exemplified by being perpendicular to the second sliding direction S2. Nevertheless, a directional relationship between the first sliding direction and the second sliding direction and a relationship between the first sliding direction and the horizontal plane are not particularly limited in other embodiments. As long as the driving member is ensured to enable the latch member to move into the engaging hole or to move out of the engaging hole, so as to secure or to dissolve a locking relationship between the first column 112 and the second column 122.

In this embodiment, the second platform 120 includes a slot way 122*a* and an engaging plate 122*b*. The slot way 122*a* is formed on an inner surface of the second column 122, and the engaging plate 122*b* is further disposed in the slot way 122*a*. The slot way 122*a* and the engaging plate 122*b* are exemplified by being disposed in the second column 122 in this embodiment, but the slot way and the engaging plate may also be disposed in the first column 112 in other embodiments.

In this embodiment, the locking device 160 also includes an operation handle 165 and the cable 166. The cable 166 has a third end 166*a* and a fourth end 166*b* opposite to each other. The operation handle 165 is disposed on the working table 121. The third end 166*a* of the cable 166 is fixed to the operation handle 165, and the fourth end 166*b* of the cable 166 is coupled to the driving member 163. Among them, the operation handle 165 may drive the cable 166, and the driving member 163 may move in the second sliding direction S2 when the cable 166 is driven.

In another aspect, the locking device 160 further includes a positioning member 164. The positioning member 164 is approximately plate-shaped, has a U-shaped cross section, is fixed to the stand 161, and may be used to restrict movement of the driving member 163. For instance, the positioning member 164 may be configured to restrict the driving member 163 not to shift in the first sliding direction S1, and the positioning member 164 may restrict movement of the driving member 163 in the second sliding direction S2.

In this embodiment, the stand 161 has a main plate 161*a* and a first abutting plate 161*b*, the first abutting plate 161*b* is connected to the main plate 161*a*. The driving member 163 has a second abutting plate 163*b* corresponding to the first abutting plate 161*b*. The locking device 160 further includes a compression spring 167. Two opposite ends of the compression spring 167 are respectively propped against the first abutting plate 161*b* and the second abutting plate 163*b*. Further, the cable 166 penetrates the compression spring 167, and the third end 166*a* is coupled to the second abutting plate 163*b*.

In this embodiment, the locking device 160 further includes an adjustment knob 168. The adjustment knob 168 is rotatably disposed on the stand 161, and the adjustment knob 168 may adjust a distance between the fourth end 166*b* of the cable 166 and the first abutting plate 161*b*. To be specific, an internal thread is disposed in the adjustment knob 168, and the adjustment knob 168 has a screw shaft 168*a*. The screw shaft 168*a* has an external thread to be matched with the internal thread in the adjustment knob 168. A hole is disposed in the screw shaft 168*a*, and the cable 166 is fixed to the hole in the screw shaft 168*a* close to a side of the fourth end 166*b*. After being rotated, the adjustment knob 168 may enable the screw shaft 168*a* to move in the second sliding direction S2. After being applied by a force to rotate, the adjustment knob 168 may drive the screw shaft 168*a*, so as to drive the cable 166 to move in the second sliding direction S2. As such, a distance between the first abutting plate 161*b* of the driving member 163 and the first abutting plate 161*b* of the stand 161 is limited by the fourth end 166*b* of the cable 166, so that the idle operation of pulling the driving member 163 by the fourth end 166*b* of the cable 166 is adjusted. In this way, when assembling the lifting device 100, the on-site operation personnel may conveniently adjust the adjustment knob 168 to perform fine adjustment on the idle operation of pulling the driving member 163 through the cable 166, and that product quality of the lifting device 100 may be more stable.

In other words, as shown in FIG. 8 to FIG. 10, when a user presses the operation handle 165, the operation handle 165 pulls the third end 166*a* of the cable 166. The fourth end 166*b* of the cable 166 pulls the driving member 163 to overcome an elastic force of the compression spring 167 and moves towards the operation handle 165 along with the third end 166*a* of the cable 166 in the second sliding direction S2. Next, the first inclined surface 163*a* of the driving member 163 pushes the second inclined surface 162*a* of the latch member 162, and the latch member 162 moves towards a direction away from the engaging holes 122*b*1 in the first sliding direction S1. The first column 112 and the second column 122 are thus unlocked. The second column 122 may thereby be able to slide freely on the first column 112 in the lifting direction T, and the relative position between the first column 112 and the second column 122 is thus changed. On the contrary, when the user releases the operation handle 165, the compression spring 167 is released and pushes the driving member 163 to move towards a direction away from the operation handle 165 in the second sliding direction S2. Simultaneously, the first inclined surface 163*a* of the driving member 163 pushes the second inclined surface 162*a* of the latch member 162, and the latch member 162 moves towards the engaging holes 122*b*1 in the first sliding direction S1 and then partially moves into the engaging hole 122*b*1 to fix the second column 122. Hence, the relative position between the second column 122 and the first column 112 is fixed, and the working table 121 is changed in height, as shown in FIG. 1.

Figure 12:
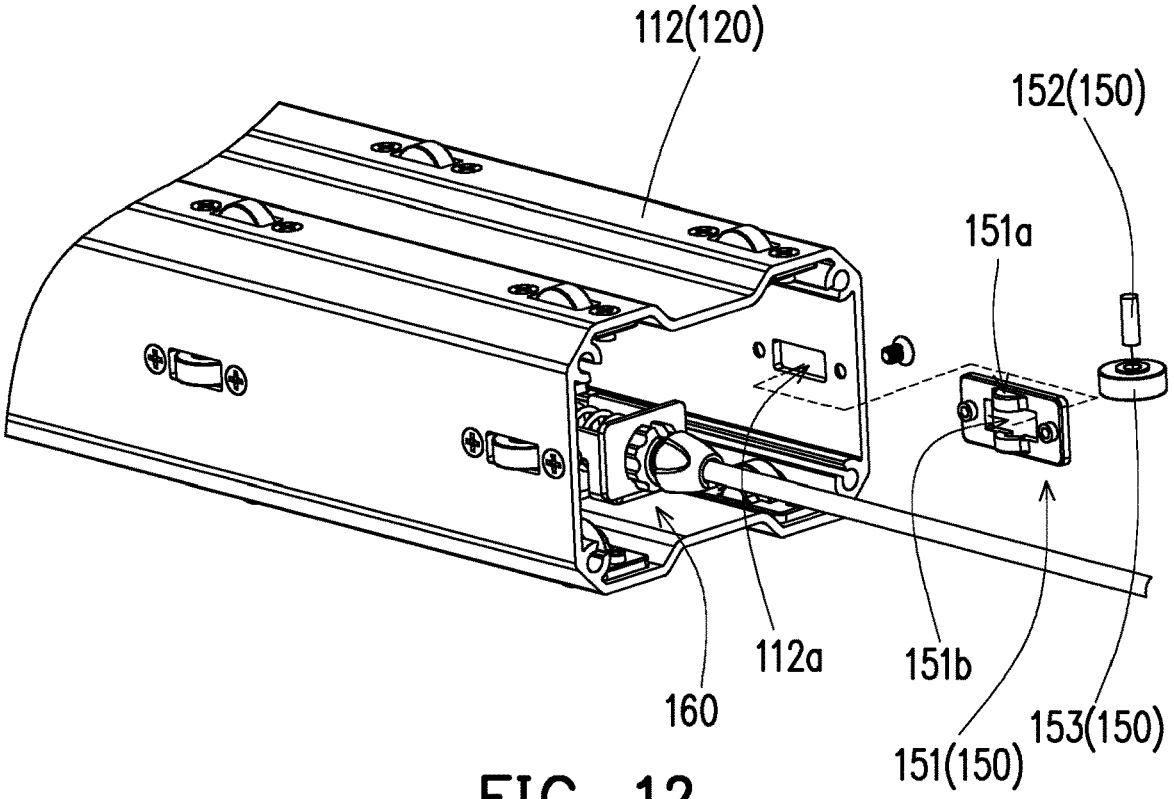
FIG. 12 is a schematic exploded view of a roller module of the lifting device in FIG. 2.

FIG. 12 is a schematic exploded view of a roller module of the lifting device in FIG. 2. In order to provide a clear illustration and a better explanation, the first column 112 is depicted in a truncated manner in FIG. 12. With reference to FIG. 2 and FIG. 12, the lifting device 100 further includes a roller module 150 disposed at the first column 112 for enabling the second column 122 to slide smoothly relative to the first column 112.

To be specific, the first column 112 has a first cavity 112*a*. The roller module 150 includes a fixing plate 151, a rotating shaft 152, and a roller 153. The fixing plate 151 is fixed to the first column 112, and the fixing plate 151 has a rotation space 151*a* and a second cavity 151*b* corresponding to the first cavity 112*a*. The rotating shaft 152 is rotatably disposed in the rotation space 151*a* of the fixing plate 151. The roller 153 is sleeved on the rotating shaft 152 and penetrates the first cavity 112*a* and the second cavity 151*b*, and the roller 153 and the second column 122 are in rolling contact with each other. In this embodiment, the roller module 150 is exemplified by being disposed at the first column 112. Nevertheless, the roller module may also be disposed at the second column in other embodiments, and a position in which the roller module is disposed is not particularly limited herein. In addition, a number of the roller 153 of this embodiment is not particularly limited. As long as the roller 153 and the second column 122 are in rolling contact with each other for reducing a friction force.

Figure 13:
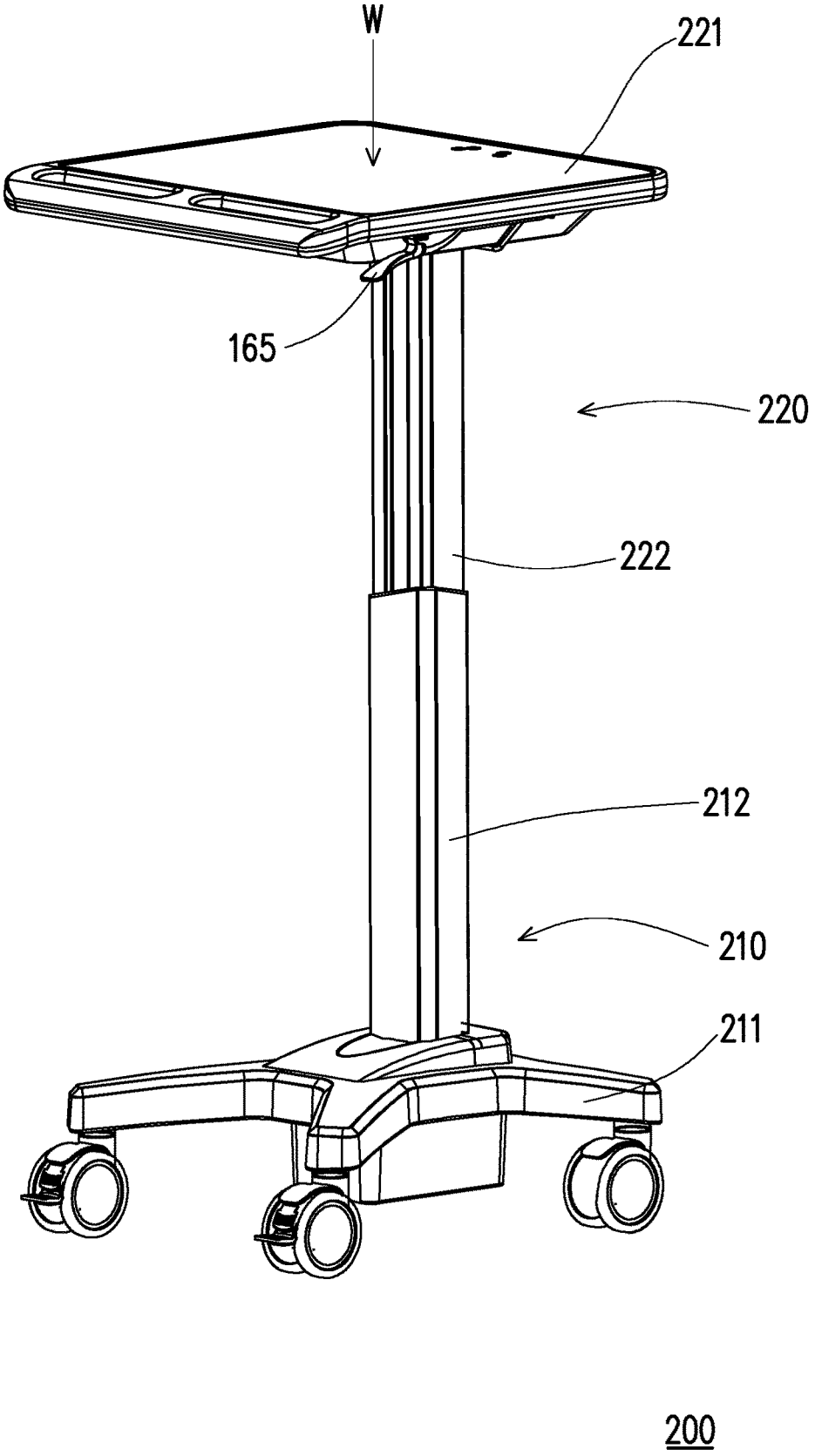
FIG. 13 is a schematic view of a lifting device according to another embodiment of the invention.
Figure 14A:
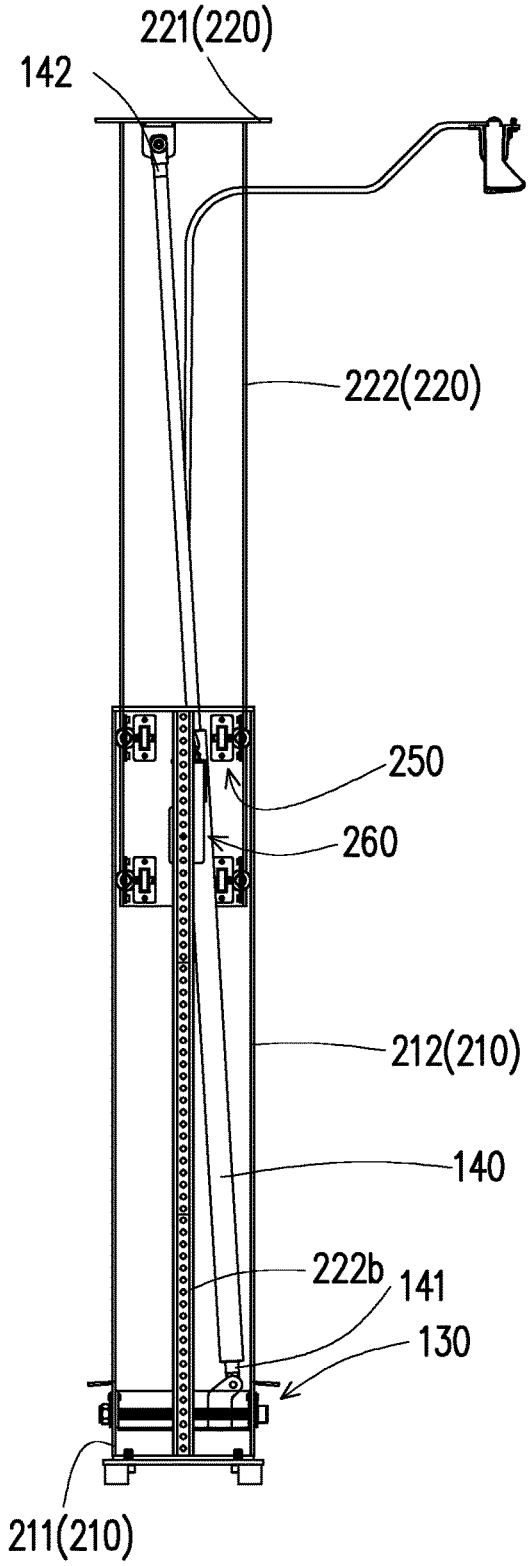
FIG. 14A and FIG. 14B are schematic views illustrating actuation of the lifting device in FIG. 13.
Figure 14B:
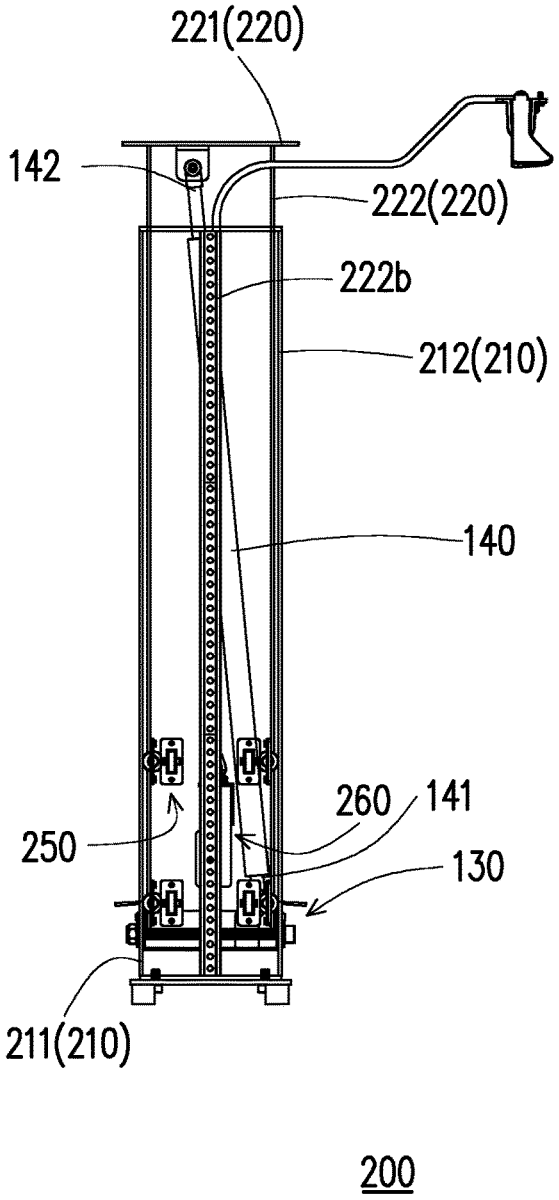

FIG. 13 is a schematic view of a lifting device according to another embodiment of the invention. FIG. 14A and FIG. 14B are schematic views illustrating actuation of the lifting device in FIG. 13. In order to provide a clear illustration and a better explanation, part of components are omitted from FIG. 14A and FIG. 14B, an internal structure of a lifting device 200 is depicted in a transparent manner, and a base 211 and a working table 221 are omitted from FIG. 14A and FIG. 14B in a truncated manner. In the lifting device 200 of this embodiment, the components identical or similar to the previous embodiment are denoted by the same or similar reference numerals, and similar content will not be described again hereinafter. With reference to FIG. 13 to FIG. 14B, the lifting device 200 includes a first platform 210, a second platform 220, an adjusting apparatus 230, and the gas spring 140.

In this embodiment, the first platform 210 includes a base 211 and a first column 212, and the second platform 220 includes the working table 221 and a second column 222. The first column 212 is fixed onto the base 211, and the second column 222 is slidably inserted in the first column 212. The working table 221 is further fixed onto the second column 222. An engaging plate 222*b* is disposed at the first column 212, and a locking device 260 is partially disposed at the second column 222. A roller module 250 is disposed at the second column 222.

In another aspect, the adjusting apparatus 230 is disposed at the base 211 of the first platform 210. The first end 141 of the gas spring 140 is rotatably disposed at the adjusting apparatus 230, and the second end 142 of the gas spring 140 is rotatably disposed below the working table 221 of the second platform 220. In this way, in the lifting device 200 provided by the embodiments of the invention, the first column 212, the second column 222, the engaging plate 222*b*, the gas spring 140, the locking device 260, and the adjusting apparatus 230 may be changed according to actual design requirement.

Figure 15A:
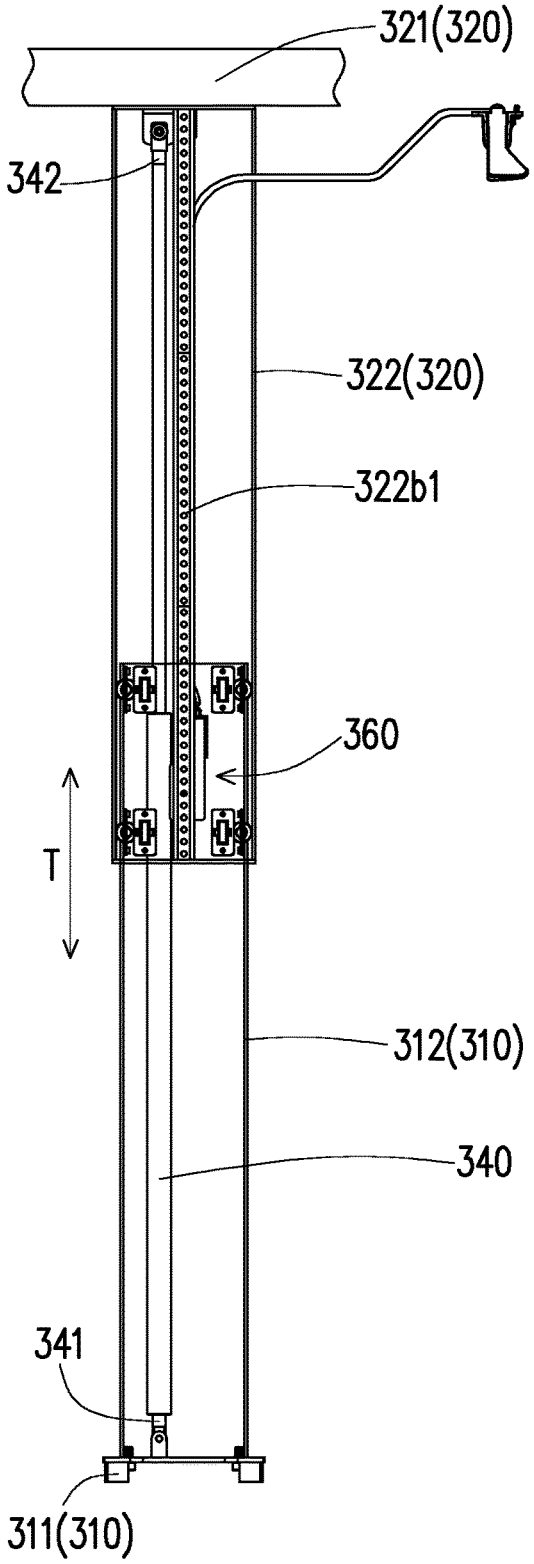
FIG. 15A and FIG. 15B are schematic views of a lifting device according to still another embodiment of the invention.
Figure 15B:
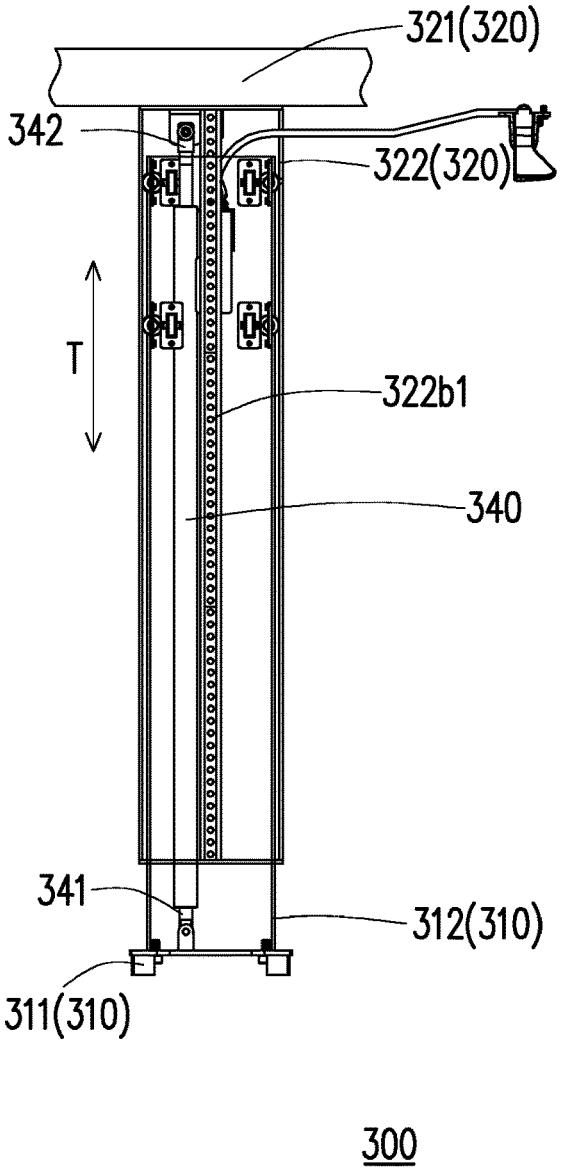

FIG. 15A and FIG. 15B are schematic views of a lifting device according to still another embodiment of the invention. With reference to FIG. 15A and FIG. 15B, a lifting device 300 of this embodiment includes a first platform 310 formed by connecting a base 311 with a first column 312, a second platform 320 formed by connecting a working table 321 with a second column 322, a gas spring 340 located in the first column 312 and the second column 322, and a locking device 360 configured to fix a relative position between the first column 312 and the second column 322. Herein, both the second column 322 and the first column 312 are movably connected, such that the working table 321 may be raised and lowered relative to the base 311 in a lifting direction T.

To be specific, the second column 322 has a plurality of engaging holes 322*b*1. The gas spring 340 includes a first end 341 and a second end 342 opposite to each other. The first end 341 of the gas spring 340 is connected to the first column 312, and the second end 342 of the gas spring 340 is connected to the second column 322. The gas spring 340 may be used to adjust a height of the working table 321 in the lifting direction T. The locking device 360 is partially disposed at the first column 312, and a portion of the locking device 360 may penetrate the engaging hole 322*b*1 to fix the relative position between the second column 322 and the first column 312. Herein, a specific structure and an actuation principle of the locking device 360 are identical to that described in the foregoing embodiments and hence are not repeated in this embodiment.

In view of the foregoing, in the lifting device provided by the embodiments of the invention, when the adjusting apparatus drives the gas spring and that the included angle is changed relative to the lifting direction of the first platform, the maximum load carrying capacity of the working table changes. As the included angle between the gas spring and the lifting direction of the first platform increases, the second component force applied to the working table by the gas spring decreases. Therefore, the user may change the maximum load carrying capacity of the working table according as required. In other words, when the central axis of the gas spring is parallel to the lifting direction of the first platform, the effective force applied to the working table by the gas spring is maximized, the maximum load carrying capacity of the working table thus reaches the maximum. On the contrary, when the included angle is provided between the gas spring and the lifting direction of the first platform, since the overall effective force of the gas spring is divided, the maximum load carrying capacity of the working table decreases. Further, when the included angle between the gas spring and the lifting direction of the first platform increases, the effective force applied to the working table by the gas spring gradually decreases, and the maximum load carrying capacity of the working table decreases as well. Hence, the user may properly adjust the included angle between the gas spring and the lifting direction of the first platform according to the weight of the object to be placed on the working table as required.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A lifting device, comprising:

a first platform, comprising a base and a first column connected to each other;

a second platform, comprising a working table and a second column connected to each other, the second column and the first column being movably connected such that the working table being raised and lowered relative to the base in a lifting direction, wherein the second column has a plurality of engaging holes;

a gas spring, comprising a first end and a second end opposite to each other, the first end connected to the first column, and the second end connected to the second column; and a locking device, partially disposed at the first column, and a portion of the locking device being adapted to penetrate the engaging holes to fix a relative position between the second column and the first column, the locking device comprises:

a stand, fixed in the first column and having an opening corresponding to the engaging holes;

a latch member, slidably inserted in the opening in a first sliding direction;

a driving member, slidably disposed at the stand and the latch member in a second sliding direction different from the first sliding direction; and a positioning member, fixed to the stand and adapted to restrict movement of the driving member, wherein the driving member is adapted to move in the second sliding direction after being applied by a force, and the latch member is adapted to move in the first sliding direction along with movement of the driving member in the second sliding direction such that a portion of the latch member is located in the engaging hole or is moved out of the engaging hole.

2. The lifting device as claimed in claim 1, further comprising:

an adjusting apparatus, disposed at the first platform, wherein the first end being rotatably disposed at the adjusting apparatus, the second end being rotatably disposed at the second platform, wherein the adjusting apparatus is adapted to adjust the first end to move in an adjustment direction and to rotate the second end so as to change a maximum load carrying capacity of the working table.

3. The lifting device as claimed in claim 2, wherein the gas spring further comprises a central axis extending along the first end and the second end of the gas spring, the central axis has a first component force in the lifting direction when the central axis is parallel to the lifting direction, and the central axis has a second component force in the lifting direction when the central axis has an included angle with respect to the lifting direction, wherein the first component force is greater than the second component force.

4. The lifting device as claimed in claim 2, wherein the gas spring is adapted to be driven along with adjustment made by the adjusting apparatus and thus has an included angle relative to the lifting direction, and the maximum load carrying capacity decreases when the included angle increases.

5. The lifting device as claimed in claim 1, wherein the first column is fixed onto the base, the second column is slidably disposed on the first column, the working table is fixed onto the second column, and the first column and the second column are mutually sleeved.

6. The lifting device as claimed in claim 1, wherein the second platform further comprises:

a slot way, located in the second column; and an engaging plate, disposed in the slot way.

7. The lifting device as claimed in claim 2, wherein the first end is rotatably disposed at the adjusting apparatus, and the second end is movably disposed at the second column.

8. The lifting device as claimed in claim 2, wherein the adjusting apparatus is disposed at the first column and located at a side of the base, wherein the second end is rotatably disposed at the second column and located at a side of the working table.

9. The lifting device as claimed in claim 1, further comprising:

a roller module, disposed at the first column, wherein the second column is slidably disposed at the first column through the roller module.

10. The lifting device as claimed in claim 9, wherein the first column has a first cavity, and the roller module comprises:

a fixing plate, fixed to the first column, the fixing plate having a rotation space and a second cavity corresponding to the first cavity;

a rotating shaft, rotatably disposed in the rotation space; and a roller, sleeved on the rotating shaft and penetrating the first cavity and the second cavity, the roller and the second column being in rolling contact with each other.

11. The lifting device as claimed in claim 2, wherein the first platform further comprises two through holes opposite to each other, and the adjusting apparatus comprises:

a rotating member, having a first threaded portion, the rotating member being rotatably inserted in the two through holes; and a sliding member, having a second threaded portion corresponding to the first threaded portion, the sliding member being screwed onto the first threaded portion through the second threaded portion, and the first end being rotatably disposed on the sliding member.

12. The lifting device as claimed in claim 11, wherein the rotating member is adapted to rotate in a rotation direction, and the sliding member is adapted to move in the adjustment direction as the rotating member rotates.

13. The lifting device as claimed in claim 11, wherein the rotating member comprises:

an adjustment head, located outside the first platform, the first threaded portion being connected to the adjustment head, the adjustment head being adapted to rotate in a rotation direction when being applied by an external force, and the first threaded portion being adapted to rotate in the rotation direction along with the adjustment head.

14. The lifting device as claimed in claim 11, wherein the sliding member comprises:

a sliding block, the second threaded portion being located in the sliding block; and a pivoting portion, connected to the sliding block, the first end being rotatably disposed on the pivoting portion.

15. The lifting device as claimed in claim 11, wherein the adjusting apparatus further comprises:

a rail base, disposed in the first column and having a sliding slot extending in the adjustment direction, wherein a portion of the sliding member is located in the sliding slot.

16. The lifting device as claimed in claim 1, wherein the driving member has a first inclined surface, the latch member has a second inclined surface corresponding to the first inclined surface, the first inclined surface of the driving member pushes the second inclined surface of the latch member when the driving member moves in the second sliding direction, wherein the first sliding direction is different from the second sliding direction.

17. The lifting device as claimed in claim 1, wherein the locking device further comprises:

an operation handle, disposed at the working table; and a cable, having a third end and a fourth end opposite to each other, the third end being fixed to the operation handle, the fourth end being coupled to the driving member, wherein the operation handle is adapted to drive the cable, and the driving member is adapted to move in the second sliding direction when the cable is driven.

18. The lifting device as claimed in claim 17, wherein the stand has a main plate and a first abutting plate, the first abutting plate is connected to the main plate, the driving member has a second abutting plate corresponding to the first abutting plate, and the locking device further comprises a compression spring, wherein two opposite ends of the compression spring respectively prop against the first abutting plate and the second abutting plate, and the fourth end is coupled to the second abutting plate.

19. The lifting device as claimed in claim 18, wherein the locking device further comprises:

an adjustment knob, rotatably disposed on the stand and adapted to adjust a distance between the fourth end and the first abutting plate, wherein the adjustment knob is adapted to drive the cable to move in the second sliding direction after being applied by a force to rotate.

* * * * *